United States Patent [19]

Dwinell et al.

[11] Patent Number: 4,905,862

[45] Date of Patent: Mar. 6, 1990

[54] PROTECTIVE CLOSURE

[75] Inventors: Davis B. Dwinell, Warren; Thomas G. Moller, Rahway, both of N.J.

[73] Assignee: American Flange & Manufacturing Co. Inc., Linden, N.J.

[21] Appl. No.: 279,506

[22] Filed: Dec. 5, 1988

[51] Int. Cl.[4] ..... B65D 51/16

[52] U.S. Cl. ..... 220/303; 220/288; 220/366

[58] Field of Search ..... 220/288, 303, 366; 215/307, 356

[56] References Cited

U.S. PATENT DOCUMENTS

| | | | |
|---|---|---|---|
| 1,346,496 | 7/1920 | Housley | 220/288 |
| 1,952,036 | 3/1934 | Dillhoefer, Jr. | 220/288 X |
| 2,282,041 | 5/1942 | Draper | 220/214 |
| 3,000,525 | 9/1961 | Leslie-Smith | 215/356 X |
| 3,905,091 | 9/1975 | La Rocque | 220/366 X |
| 4,004,709 | 1/1977 | Simkus | 220/288 X |
| 4,105,135 | 8/1978 | Bradshaw et al. | 220/288 |
| 4,706,836 | 11/1987 | Greck | 220/288 X |

*Primary Examiner*—Stephen Marcus
*Assistant Examiner*—Nova Stucker

[57] ABSTRACT

A lightweight metal protective closure for covering the threaded dispensing openings in steel shipping drums during the drum exterior painting process. The closure is formed as a shallow cup having a bottom wall surrounded by an upstanding sidewall. The sidewall is formed with a single embossed thread and terminates in a circumferentially extending radially fluted lip. The lip is contoured to closely overlie and protect the exposed top surfaces of the upstanding opening neck from deleterious paint coverage leaving the lower neck surfaces exposed.

9 Claims, 1 Drawing Sheet

PROTECTIVE CLOSURE

BACKGROUND OF THE INVENTION

Users of industrial size shipping containers such as 55 gallon steel drums now demand a very high standard of drum interior purity due to the super sensitive nature of many drummed products. This requirement has placed a burden on the drum manufacturer to assure delivery of drums absolutely free of interior contamination. One step in the drum making process where such contamination was heretofore likely to occur involved the exterior spray painting of the completed drum. Specifically, the problem has been one of adequately covering the threaded dispensing openings in the drum head to prevent the entry of spray paint. Such openings are commonly surrounded by an upstanding neck terminating in an outwardly curled bead. Besides preventing paint entry, it is also necessary to protect the upwardly exposed bead surface from paint coverage so that subsequent plugging operations do not chip any paint particles into the drum. Consequently, it has become common practice to apply some type of protective cover over the drum openings prior to the paint operation.

In addition to meeting the above essential criteria, it is of equal importance that any protective closure employed by quickly and easily applied and removed without, in itself, inflicting any damage or detrimental abrasive action on the threaded opening. Another consideration in the drum painting process which is carried out by rotating the drum about its longitudinal axis in the path of a fixed paint gun, is the degree of undesirable shielding caused by a protective closure. What may seem like a very minor change in the opening neck profile due to the presence of a protective closure, can seriously detract from the amount of paint coverage obtainable on the opening neck exterior immediately below the bead. This condition is objectionable as it leaves a band of unpainted metal round the opening which quickly rusts. Accordingly, a balance must be struck with the protective closure between keeping undesirable paint off of the critical surfaces of the opening bead and thread on the one hand while enabling complete coverage of the lower exterior neck surfaces on the other hand.

Yet another consideration comes into being when the painted drum is then conveyed through the curing oven. The elevated baking temperature causes air inside the drum to rapidly expand which unless vented to the outside, will bulge and damage the drum. Once again, a satisfactory protective closure must prevent the entry of paint at one step in the process and let expanding hot air escape at another step. Moreover, the closure must resist dislodgement or blow off at one point and be easily and quickly removed when hot exiting the oven at another point. The task is formidable.

Of the many attempts at solving the problem a few bear mentioning. A common approach has been to simply thread an ungasketed closure plug into the opening neck. This leaves the entire bead surface surrounding the opening exposed to paint coverage and is unsatisfactory. Another approach has been to apply an overcap which has a series of spring fingers that releasabily snap over the opening bead. This has a shielding effect causing incomplete paint coverage of the lower neck surfaces. Yet another approach has been to employ a protective cap having a crown-like fluted skirt which engages over the maximum outside diameter of the opening bead. This cannot accommodate the range of bead tolerances from drum to drum and gets blown off when going through the curing oven. Still another approach has been to employ a large grippable disc having a pair of radially outwardly spring biased legs depending from the undersurface which are compressed radially inwardly when forced into the openings so as to hold the disc on the bead. This construction is far too abrasive on the opening threads is too costly and shields the exterior of the neck too much. A simple solution to this complex problem has been elusive.

SUMMARY OF THE INVENTION

This invention is directed to a protective closure for use in drum painting operations.

The protective closure of the invention although very simplistic in design is believed to overcome all of the above mentioned prior art deficiencies. In constructional detail it consists of a shallow drawn metal cup having a flat bottom wall surrounded by an upstanding cylindrical sidewall which terminates in a circumferential lip. A simple helical thread is formed in the sidewall in an intermediate zone leaving upper and lower unthreaded portions. The circumferential lip extends radially outwardly from the threaded sidewall and, as viewed in vertical cross section, has a generally semicircular configuration creating a concavely rounded undersurface. This undersurface matches very closely the bead curvature normally present at the uppermost end of threaded drum openings. The contour of the closure lip has been worked out to afford maximum protection against paint exposure to the underlying threaded opening neck while at the same time minimizing any shielding effect on the exterior neck surfaces where paint coverage is required. More precisely, the optimum relationship for achieving the above mentioned objectives has been found to be a lip contour wherein the radial width of the lip as viewed in vertical cross section is between two and three times the vertical height of the lip. In addition, the protective closure so constructed is easily engagable within the threaded drum openings with very little opportunity for abrasion or chipping of applied internal drum coatings. Venting of the drum interior as required to prevent internal pressure build-up from the oven curing temperatures is also effectively accomplished.

It is accordingly a principal object of the invention to provide a new and improved protective closure for temporarily covering the threaded openings in industrial size steel shipping containers during in-process painting and handling operations prior to filling.

Another object is to provide an inexpensive protective closure used in combination with the threaded opening necks on steel drums so as to prevent paint coverage on the opening mouth while at the same time permitting paint coverage of the adjacent exterior neck surface.

A further object is to provide a protective paint cap which can be quickly and easily applied and removed from the drum without damaging the neck opening threads.

Other and more detailed objects will in part be obvious and in part pointed out as the description taken in conjunction with accompanying drawing proceeds.

Figure 1:
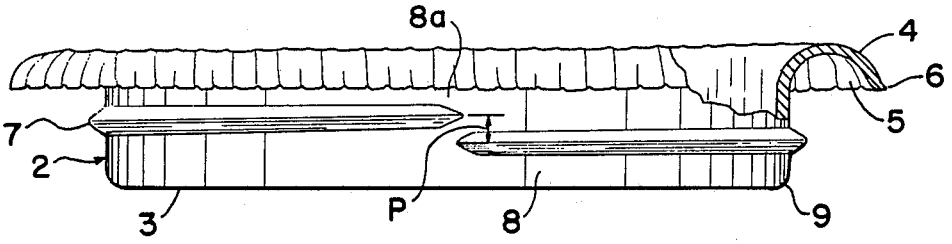
FIG. 1 is a vertical cross-sectional view of the protective closure in accordance with the invention.

The protective closure of the invention generally designated at 1 consists of a drawn metal cup having a cylindrical sidewall 2 surrounding a disc-like bottom wall 3. The cup may be drawn from any readily formable metal, however, good results have been achieved with 0.010 to 0.016 inch tinplate or tin free steel. The uppermost end of sidewall 2 is curled radially outwardly into a circumferential lip 4 creating a downwardly opening substantially semicircular concave undersurface 5. More specifically, the radial width "W" of the lip 4, as viewed in vertical cross section, measures less than three times the vertical height "H" of the lip and more than two times the vertical height of the lip. This particular relationship has proven advantageous in carrying out the objects of the invention as will be further explained hereinafter. The outermost edge of lip 4 is wrinkled or fluted at 6 to provide an effective gripping surface. A single helical screw thread 7 is formed in the midsection of the sidewall 2 by roller swagging the metal throughout approximately 360 degrees into a smooth evenly rounded thread profile. The position of the thread on closure sidewall is important in terms of functionality. The sidewall 2 immediately adjacent the bottom wall 3 has an unthreaded pilot portion 8 for a distance at least equal to the pitch of the thread 7, the pitch distance being indicated by the letter "P" in FIG. 1. The pilot portion 8 together with the radiused juncture 9 between the bottom and sidewall facilitate smooth initial thread engagement. Also of importance, a similar minimum spacing "P" is provided at 8*a* above the thread 7 and below the horizontal plane of the lip free edge 6. This positioning serves the purpose of minimizing the amount of thread engagement required to seat and unseat the protective closure.

Figure 2:
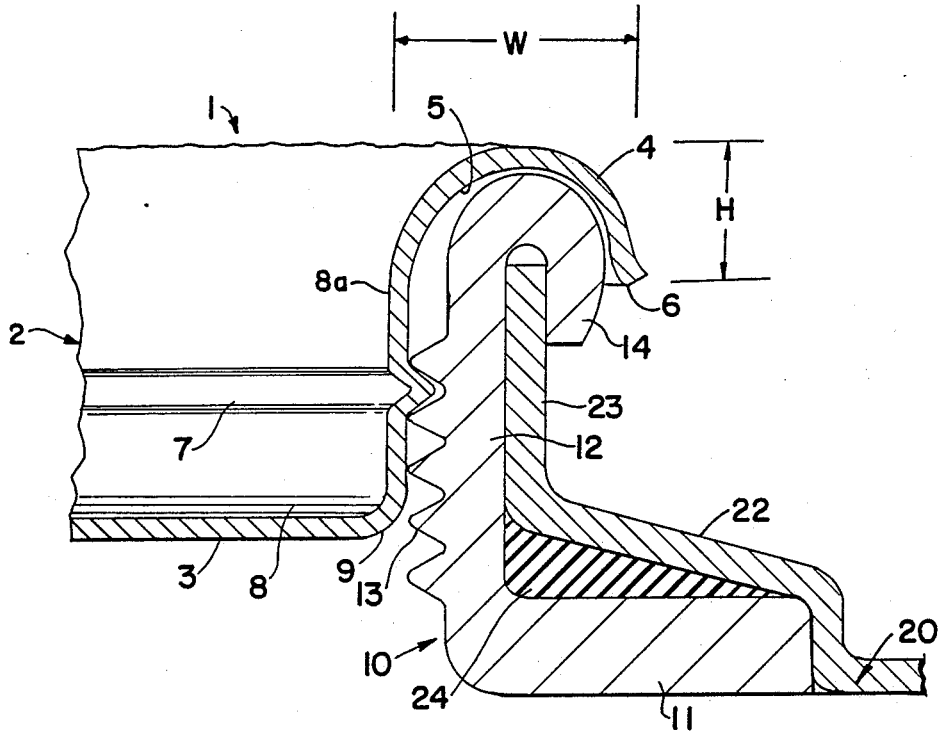
FIG. 2 is an enlarged fragmentary sectional view of the protective closure in threaded operative engagement with the drum opening neck.

As seen in FIG. 2, the protective closure 1, in practice, is threaded into a dispensing opening in a large size industrial container such as a 55 gallon steel drum. Such openings normally consist of a steel bushing 10 having a circumferentially extending polygonal base 11 surrounding an upstanding cylindrical wall 12. The wall 12 has an internally threaded lower portion as indicated at 13 and an unthreaded upper portion 14 which is curled radially outwardly and doubled back on itself forming a closed bead. The bushing 10 is pressed into the wall 20 of a container or drum 21 having a polygonal embossment 22 which receives the base 11 and an upstanding cylindrical neck 23 surrounding the threaded wall 12. With the bushing thus nested in the above described container wall opening, outwardly curling of the bead 14 locks the parts in position with the gasket 24 tightly compressed creating a liquid light, torque resistant joint.

In practice, the protective closure 1 is placed over the opening on the upright drum 21 so that the radiused juncture 9 guides the unthreaded pilot portion 8 into the bushing 10 resting within the unthreaded upper wall 14 just above the thread 7. This accurately positions the protective closure for a very quick and easy thread start. With minimal rotational displacement the single thread engagement is complete bringing the undersurface 5 of the lip 4 on top of bushing bead portion 14. A positive grip is enhanced by the fluted lip edge 6 enabling an efficient spin in spin out action. With the protective closure in seated position it can be seen that the major portion of the bead surface is covered by the lip 4 leaving only the outer portion of bead 14 exposed from the approximate midpoint of the bead down to the neck 23. This is important because the inner bead surface above the thread 13 forms a gasket seat when the drum is sealed with a conventional closure plug. Any paint on this surface will detract from the plug gasket performance and may also contaminate the drum contents.

Figure 3:
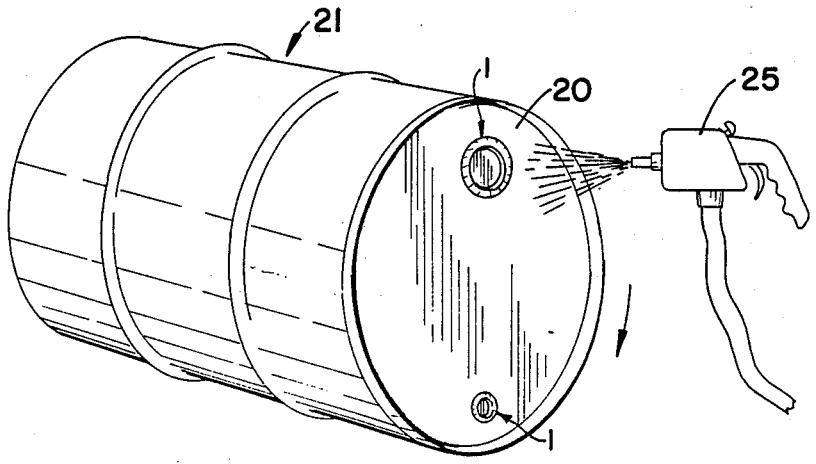
FIG. 3 shows a steel drum with protective closures applied during the painting operation.

FIG. 3 shows how the drum painting process is performed. Firstly, the drum is rather violently dropped to a horizontal orientation which will throw the protective closures off unless the closure very firmly engages the opening. Then, with the paint spray gun 25 directed at the closure opening, the drum is rotated about its longitudinal axis. As is readily apparent, unless the top and inwardly facing surfaces of the bead 14 are completely protected, some paint coverage will occur on these surfaces as the drum rotates. On the other hand, if the free edge 6 of the closure lip 4 extends much below the midpoint of the bead 14 the result is an undesirable shielding of paint from the container wall neck 23. Although one might not expect this to be the case, it appears to be a result of the turbulence created around the drum openings when the drum is rotated in the spray pattern. Thus in order to achieve as much paint coverage as possible on the container wall neck, the free edge 6 is dimensioned to extend to the approximate midpoint of the bead 14.

After painting, the drum enters a drying oven where the elevated temperature quickly cures the exterior paint and also quickly expands the air inside the closed drum. At this point in the process it becomes evident that the protective closure must seat on the opening tight enough during the spraying operation to keep the paint out but loose enough during the curing cycle to allow venting of the drum as the air trapped inside rapidly expands. If this venting action does not occur, either the drum bulges and becomes damaged through distortion or the protective closure blows off in the oven to become entangled in the conveyor system. The wrinkling or fluting at the lip free edge 6, besides providing a readily grippable surface, assures adequate venting should the otherwise metal to metal contact become over-tightened. Finally, the horizontal fully cured drum exits the oven and in doing so is again quite violently pivoted to an upright position which again requires the protective closure having a firm attachment to the opening even after any effect the oven heat may have on it. After the drums travel through a cooling chamber, the protective closures, still very hot, are removed. Even though gloves must be worn, the quick spin out action and fluted grip substantially improve the efficiency of this operation.

Upon subsequent full threaded engagement of a gasketed closure plug, the advantages of the protective closure of the invention become even more clearly evident. Most notably the upwardly and radially inwardly facing surfaces of the flange bead 14 are free of paint due to the protection offered by the lip 4. The plug gasket (not shown) can then tightly engage these surfaces without wiping paint particles into the drum and without sticking and looping out away from the plug as frequently occurs on a painted surface.

Various other changes in or modifications of the protective closure of the invention would suggest themselves to those skilled in the art and could be made without departing from the spirit or scope of this invention. It is accordingly intended that all matter contained in the above description or shown in the accompanying drawing shall be interpreted as being illustrative and not in a limiting sense.

We claim:

1. In container closure construction, a steel drum fabricated in preparation for exterior paint spraying having at least one recloseable fluid dispensing opening, an upstanding neck having an internal screw thread surrounding said opening, an outwardly curled bead at the uppermost end of said neck adjacent said screw thread, said bead presenting an arcuate exposed metal surface extending in excess of 180 degrees as viewed in vertical cross-section, a lightweight metal protective closure covering said opening so as to allow the escape of expanding hot air therearound, said closure being formed as a shallow open cup having a bottom wall, a threaded sidewall in engagement with said neck and a circumferential lip at the uppermost end of said sidewall contoured to closely overlie said exposed metal surface, said lip terminating in a circular gripping edge in close proximity to the outside diameter of said neck bead so as to shield said bead surface from paint spray while leaving the entire neck exterior below said bead surface exposed.

2. In container closure construction as in claim 1 wherein said closure lip is concavely curved and closely overlies the exterior surface of said neck bead terminating at the approximate maximum outside diameter of said bead.

3. In container closure construction as in claim 1 and said sidewall thread extends for no more than one full turn.

4. In container closure construction as in claim 1 and said sidewall haivng an unthreaded pilot portion adjacent said bottom wall.

5. A lightweight metal protective closure for covering the threaded openings in steel shipping containers during the exterior painting process comprising a shallow open cup having a flat bottom wall, an upstanding cylindrical sidewall surrounding said bottom wall, a single embossed helical screw thread formed in said sidewall, said sidewall having an unthreaded pilot portion adjacent said bottom wall, and a circumferential lip extending from said sidewall, said lip as viewed in vertical cross section having a concave substantially semicircular undersurfce, said lip terminating in a downwardly facing free edge wherein the radial width of said lip in vertical cross section is less than three times the vertical height of said lip and greater than two times the vertical height of said lip.

6. A lightweight metal protective closure as in claim 5 wherein said helical screw thread extends to a point on said sidewall vertically spaced no more than the pitch of said thread from the horizontal plane of said lip free edge.

7. A lightweight metal protective closure as in claim 5 wherein manual gripping means are provided at said lip free edge.

8. A lightweight metal protective closure as in claim 5 and including a radially extending venting passage formed in said lip.

9. A lightweight metal protective closure as in claim 5 wherein said helical thread extends to a point on said sidewall vertically spaced a distance from said bottom wall at least equal to the pitch of said thread.

* * * * *